US006153138A

United States Patent [19]

Helms, Jr. et al.

[11] Patent Number: 6,153,138

[45] Date of Patent: Nov. 28, 2000

[54] PROCESS FOR MODIFYING SYNTHETIC BICOMPONENT FIBER CROSS-SECTIONS

[75] Inventors: Charles F. Helms, Jr.; Otto M. Ilg, both of Asheville; Diane R. Kent, Arden; Matthew B. Hoyt, Arden; John A. Hodan, Arden, all of N.C.

[73] Assignee: BASF Corporation, Mt.Olive, N.J.

[21] Appl. No.: 09/288,185

[22] Filed: Apr. 8, 1999

Related U.S. Application Data

[60] Division of application No. 08/980,232, Nov. 28, 1997, Pat. No. 5,948,528, which is a continuation-in-part of application No. 08/741,311, Oct. 30, 1996, abandoned.

[51] Int. Cl.[7] ..... B29D 31/00; D01D 5/253; D01D 8/04; D01D 8/12; D01D 5/24

[52] U.S. Cl. ..... 264/147; 264/172.12; 264/172.13; 264/172.14; 264/172.15; 264/172.17; 264/172.18; 264/172.1

[58] Field of Search ..... 264/147, 172.1, 264/172.12, 172.13, 172.14, 175.15, 172.17, 172.18, 177.13

[56] References Cited

U.S. PATENT DOCUMENTS

| | | | |
|---|---|---|---|
| 3,671,379 | 6/1972 | Evans et al. . | |
| 3,718,534 | 2/1973 | Okamoto et al. . | |
| 3,726,955 | 4/1973 | Hughes et al. . | |
| 3,729,449 | 4/1973 | Kimura et al. | 264/172.12 X |
| 4,069,363 | 1/1978 | Segraves et al. . | |
| 4,439,487 | 3/1984 | Jennings | 428/397 |
| 4,713,291 | 12/1987 | Sasaki et al. | 428/373 |
| 4,732,809 | 3/1988 | Harris et al. | 428/373 |
| 4,861,661 | 8/1989 | Samuelson | 428/398 |
| 5,125,818 | 6/1992 | Yeh | 425/131.5 |
| 5,162,074 | 11/1992 | Hills . | |
| 5,202,185 | 4/1993 | Samuelson | 428/373 |
| 5,208,107 | 5/1993 | Yeh et al. | 428/397 |
| 5,244,614 | 9/1993 | Hagen | 264/172.12 X |
| 5,322,736 | 6/1994 | Boyle et al. | 428/397 |
| 5,344,297 | 9/1994 | Hills | 425/131.5 |
| 5,445,884 | 8/1995 | Hoyt et al. | 428/370 |
| 5,458,972 | 10/1995 | Hagen | 428/397 |
| 5,620,641 | 4/1997 | Berger | 264/172.12 X |

OTHER PUBLICATIONS

Introduction to Physical Polymer Science, L. H. Sperberg, 1986, John Wiley & Love, Inc.

*Primary Examiner*—Leo B. Tentoni

[57] ABSTRACT

Bicomponent fibers of different cross-sections may be formed without changing the geometry of the spinneret orifices. More specifically, at least two polymers are co-melt-spun through an orifice of fixed geometry so as to achieve a bicomponent fiber having a desired cross-section. In order to change to a bicomponent fiber having a cross-section which is different, therefore, at least one of (1) the differential relative viscosity, (2) the relative proportions of the first and/or second polymers, and (3) the cross-sectional bicomponent distribution of the first and second polymers, is changed. In such a manner, therefore, a wide variety of bicomponent fibers having different cross-sectional geometries may be produced without changing the fixed geometry orifice through which the polymers are co-melt-spun. Thus, bicomponent fiber cross-sections may be "engineered" to suit a variety of needs without necessarily shutting down production equipment in order to change spinnerets. The bicomponent fibers are most preferably multilobal (e.g., trilobal) in which the core component is generally triangularly shaped.

18 Claims, 7 Drawing Sheets

PROCESS FOR MODIFYING SYNTHETIC BICOMPONENT FIBER CROSS-SECTIONS

CROSS-REFERENCE TO RELATED APPLICATION

This application is a divisional application of U.S. application Ser. No. 08/980,232 filed on Nov. 28, 1997, now issued U.S. Pat. No. 5,948,528 on Sep. 7, 1999; which was a continuation-in-part application of U.S. application Ser. No. 08/741,311 filed on Oct. 30, 1996, now abandoned.

FIELD OF INVENTION

The present invention relates generally to the field of synthetic fibers. More specifically, the present invention relates to processes for manufacturing bicomponent fibers. In particularly preferred forms, the present invention is embodied in processes by which the cross-sectional geometries of bicomponent fibers may be "engineered" by selective co-spinning of polymer components having different relative viscosities.

BACKGROUND AND SUMMARY OF THE INVENTION

Bicomponent fibers are, in and of themselves, well known and have been used extensively to achieve various fiber properties. For example, bicomponent fibers have been formed of two dissimilar polymers so as to impart self-crimping properties. See, U.S. Pat. No. 3,718,534 to Okamoto et al and U.S. Pat. No. 4,439,487 to Jennings. Bicomponent fibers of two materials having disparate melting points for forming point bonded nonwovens are known, for example, from U.S. Pat. No. 4,732,809 to Harris et al. Asymmetric nylon-nylon sheath-core bicomponent fibers are known from U.S. Pat. No. 4,069,363 to Seagraves et al.

The particular cross-sectional geometry of synthetic fibers is also well known to affect certain physical properties. For example, yarns formed of trilobal cross-section fibers have been used extensively as carpet face fibers. Fibers of virtually any cross-sectional geometry are formed by melt-spinning fiber-forming polymers though specially designed spinnerets. That is, in order to achieve fibers of a specific cross-sectional geometry, a corresponding spinneret orifice of specific geometric design is typically needed. Therefore, the present state of this art requires that different spinnerets be provided for each different cross-sectional fiber geometry that is desired to be melt-spun. Spinnerets dedicated to only a single cross-sectional geometry clearly mitigate against processing flexibility since, in order to change a particular spinning line from the production of one fiber cross-section to the production of a different fiber cross-section, the entire spinning line must be shut down to allow for physical installation of a spinnerets dedicated to the new fiber cross-section.

It would therefore be highly desirable if a process could be provided whereby a single spinneret design would be capable of forming fibers of various desired cross-sectional geometries. It is toward fulfilling such a need that the present invention is directed.

Broadly, according to the present invention, bicomponent fibers of different cross-sections may be formed without changing the geometry of the spinneret orifices. More specifically, according to the present invention, at least two polymers are co-melt-spun through an orifice of fixed geometry so as to achieve a bicomponent fiber having a desired cross-section. In order to change to a bicomponent fiber having a cross-section which is different, therefore, at least one of (1) the differential relative viscosity between the first and second polymers, (2) the relative proportions of the first and/or second polymers, and (3) the cross-sectional bicomponent distribution of the first and second polymers, is changed. In such a manner, therefore, a wide variety of bicomponent fibers having different cross-sectional geometries may be produced without changing the fixed geometry orifice through which the polymers are co-melt-spun. Thus, bicomponent fiber cross-sections may be "engineered" to suit a variety of needs without necessarily shutting down production fiber-spinning equipment in order to change spinnerets.

Further aspects and advantages of this invention will become more clear from the following detailed description of the preferred exemplary embodiments.

BRIEF DESCRIPTION OF THE ACCOMPANYING FIGURES

Reference will hereinafter be made to the accompanying drawing FIGURES, wherein

DETAILED DESCRIPTION OF THE PREFERRED EXEMPLARY EMBODIMENTS

Figure 1:
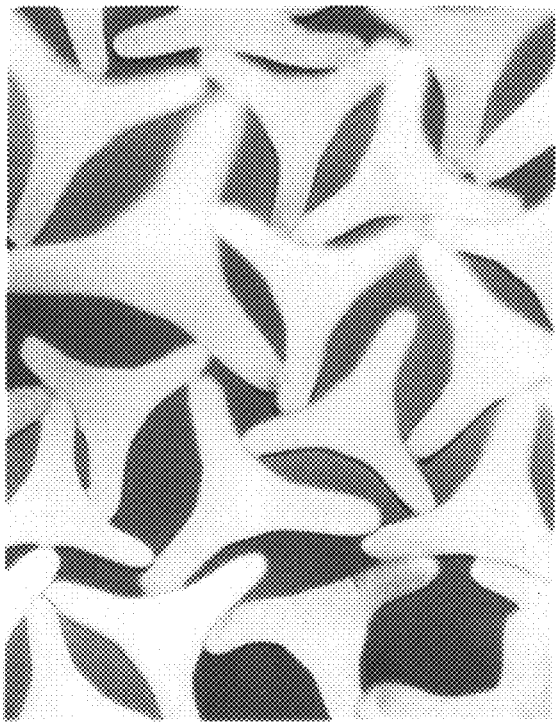
FIGS. 1–6 are photomicrographs of fiber cross-sections each taken at a magnification of 383× corresponding to the fibers produced in accordance with Examples 1–6 below, respectively.
Figure 2:
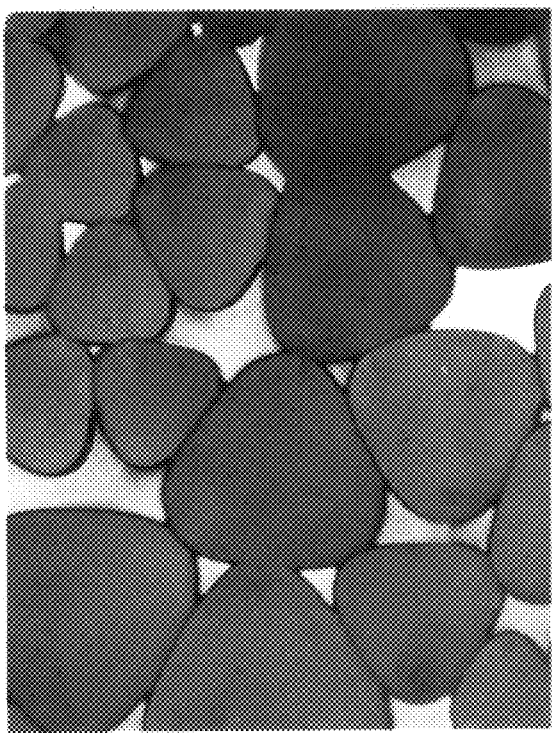
Figure 3:
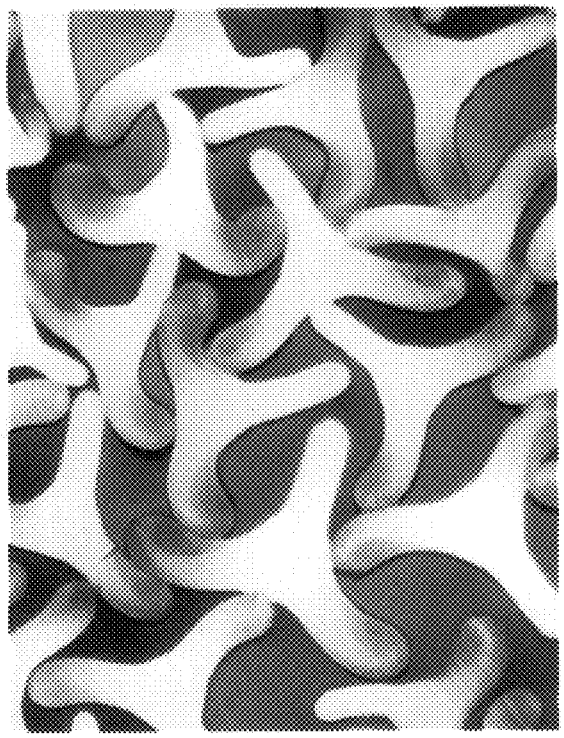
Figure 4:
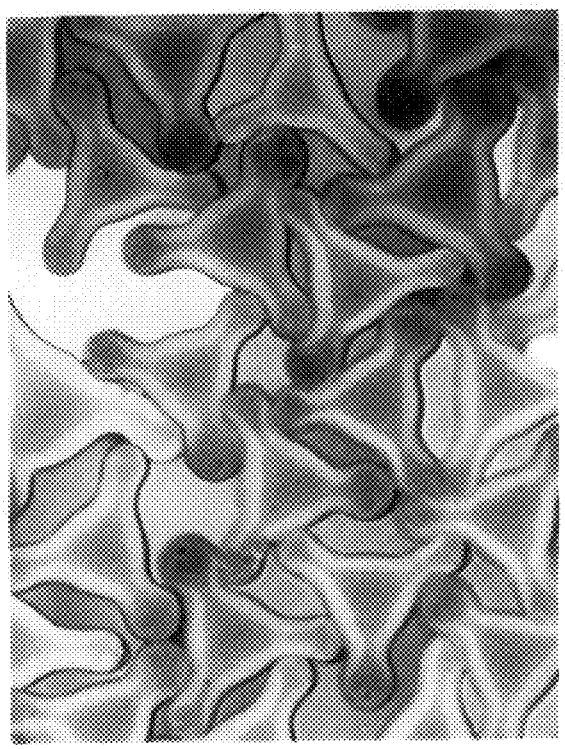
Figure 5:
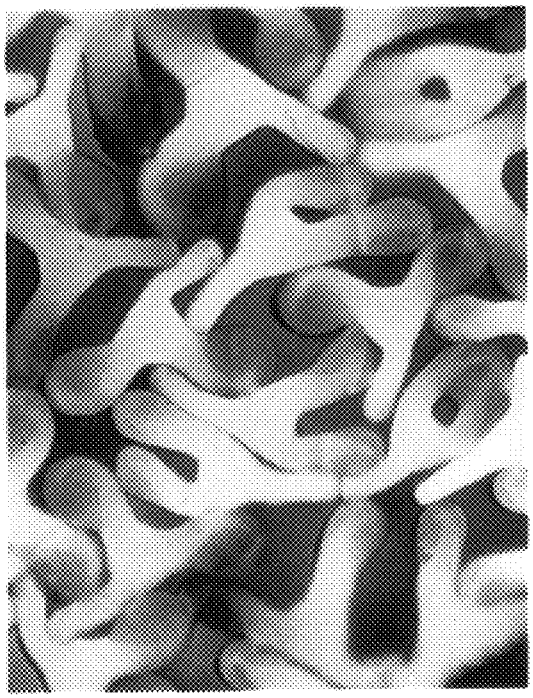
Figure 6:
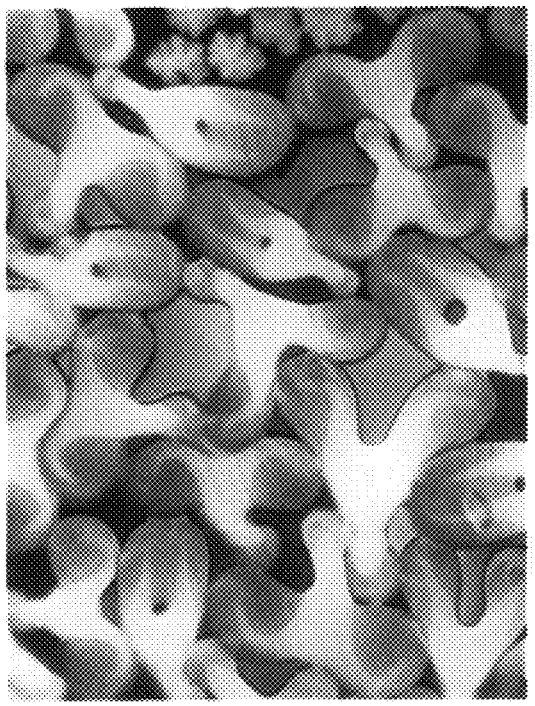

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%.

The term "fiber" includes fibers of extreme or indefinite length (filaments) and fibers of short length (staple). The term "yarn" refers to a continuous strand or bundle of fibers.

The term "bicomponent fiber" is a fiber having at least two distinct cross-sectional domains respectively formed of polymers having different relative viscosities. The distinct domains may thus be formed of polymers from different polymer classes (e.g., nylon and polypropylene) or be formed of polymers from the same polymer class (e.g., nylon) but which differ in their respective relative viscosities. The term "bicomponent fiber" is thus intended to include concentric and eccentric sheath-core fiber structures, symmetric and asymmetric side-by-side fiber structures, island-in-sea fiber structures and pie wedge fiber structures.

The term "cross-sectional bicomponent distribution" is meant to refer to the relative positions or locations of the different polymer domains in a cross-section of the bicomponent fiber. Thus, according to the present invention, changing one of the polymer domains from the core to the sheath of a sheath-core bicomponent fiber while the other polymer domain is changed from the core to the sheath of the sheath-core bicomponent fiber will result in bicomponent fibers of different cross-sectional geometries.

The terms "relative viscosity" and its abbreviation "RV" are intended to refer to the viscosity property ($\eta_{rel}$) of a fiber-forming polymer which is the ratio of the viscosity of the polymer solution ($\eta$) to the solvent viscosity ($\eta_o$), that is, $\eta_{rel}=\eta/\eta_o$.

The terms "differential relative viscosity" and its abbreviation "$\Delta\eta_{rel}$" are meant to refer to the absolute difference between the relative viscosity ($\eta_{rel1}$) of the fiber-forming polymer which constitutes one domain of the bicomponent fiber and the relative viscosity ($\eta_{rel2}$) of another fiber-forming polymer which constitutes at least one other domain of the bicomponent fiber—i.e., $|\eta_{rel1}-\eta_{rel2}|=\Delta\eta_{rel}$.

Virtually any fiber-forming polymer may usefully be employed in the practice of this invention. In this regard, suitable classes of polymeric materials that may be employed in the practice of this invention include polyarnides, polyesters, acrylics, olefins, maleic anhydride grafted olefins, and acrylonitriles. More specifically, nylon, low density polyethylene, high density polyethylene, linear low density polyethylene and polyethylene terephthalate may be employed. Each distinct domain forming the bicomponent fibers of this invention may be formed from different polymeric materials having different relative viscosities. Alternatively, each domain in the bicomponent fiber may be formed from the same polymeric materials, provided that the polymeric materials of the respective domains exhibit different relative viscosities.

The preferred polymers used in forming the bicomponent fibers of this invention are polyarnides. In this regard, those preferred polyarnides useful to form the bicomponent fibers of this invention are those which are generically known by the term "nylon" and are long chain synthetic polymers containing amide (—CO—NH—) linkages along the main polymer chain. Suitable melt spinnable, fiber-forming polyarnides for the sheath of the sheath-core bicomponent fibers according to this invention include those which are obtained by the polymerization of a lactam or an amino acid, or those polymers formed by the condensation of a diamine and a dicarboxylic acid. Typical polyarnides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyarnides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-ε-caprolactam (nylon 6) and polyhexamethylene adipamide (nylon 6/6). Most preferred is nylon 6. The preferred polyarnides will exhibit a relative viscosity of between about 2.0 to about 4.5, preferably between about 2.4 to about 4.0.

As noted previously, at least two of the polymers employed in the bicomponent fibers of this invention exhibit a differential relative viscosity therebetween. Most preferably, the differential relative viscosity of the two polymer components forming distinct polymer domains in the cross-section of the bicomponent fibers is at least about 0.3, and more preferably at least about 0.5. Particularly good results ensue when the differential relative viscosity is between about 0.7 to about 2.0, more preferably between about 0.9 to about 1.6.

The bicomponent fibers are spun using conventional fiber-forming equipment. Thus, for example, separate melt flows of the polymers having different relative viscosities may be fed to a conventional bicomponent spinneret pack such as those described in U.S. Pat. Nos. 5,162,074, 5,125,818, 5,344,297 and 5,445,884 (the entire content of each patent being incorporated expressly hereinto by reference) where the melt flows are combined to form extruded multilobal (e.g., tri-, tetra-, penta- or hexalobal) fibers having two distinct polymer domains, for example, sheath and core structures. Preferably, the spinneret is such that fibers having a tri-lobal structure with a modification ratio of at least about 1.2, more preferably between about 2.0 and about 4.0 may be produced. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section. According to the present invention, modification ratios of between about 1.2 to about 4.0 may be obtained without changing the geometry of the spinneret.

The extruded fibers are quenched, for example with air, in order to solidify the fibers. In this regard, the differential relative viscosities of the polymer domains when spun will cause that polymer with the greater relative viscosity to solidify faster than that polymer with the lesser relative viscosity. This difference in solidification rates as between the respective polymers forming the polymer domains of the bicomponent fibers of this invention will therefore effect different cross-sectional geometries to be assumed when both domains completely solidify. As a result of changing the relative viscosities of the individual polymer components and/or their relative proportions (in terms of weight percentages) in the bicomponent fibers and/or their cross-sectional distribution, therefore, various bicomponent fiber cross-sectional geometries may be produced.

The fibers may then be treated with a finish comprising a lubricating oil or mixture of oils and antistatic agents. The thus formed fibers are then combined to form a yarn bundle which is then wound on a suitable package.

In a subsequent step, the yarn is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 25 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 1½ to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

Figure 7:
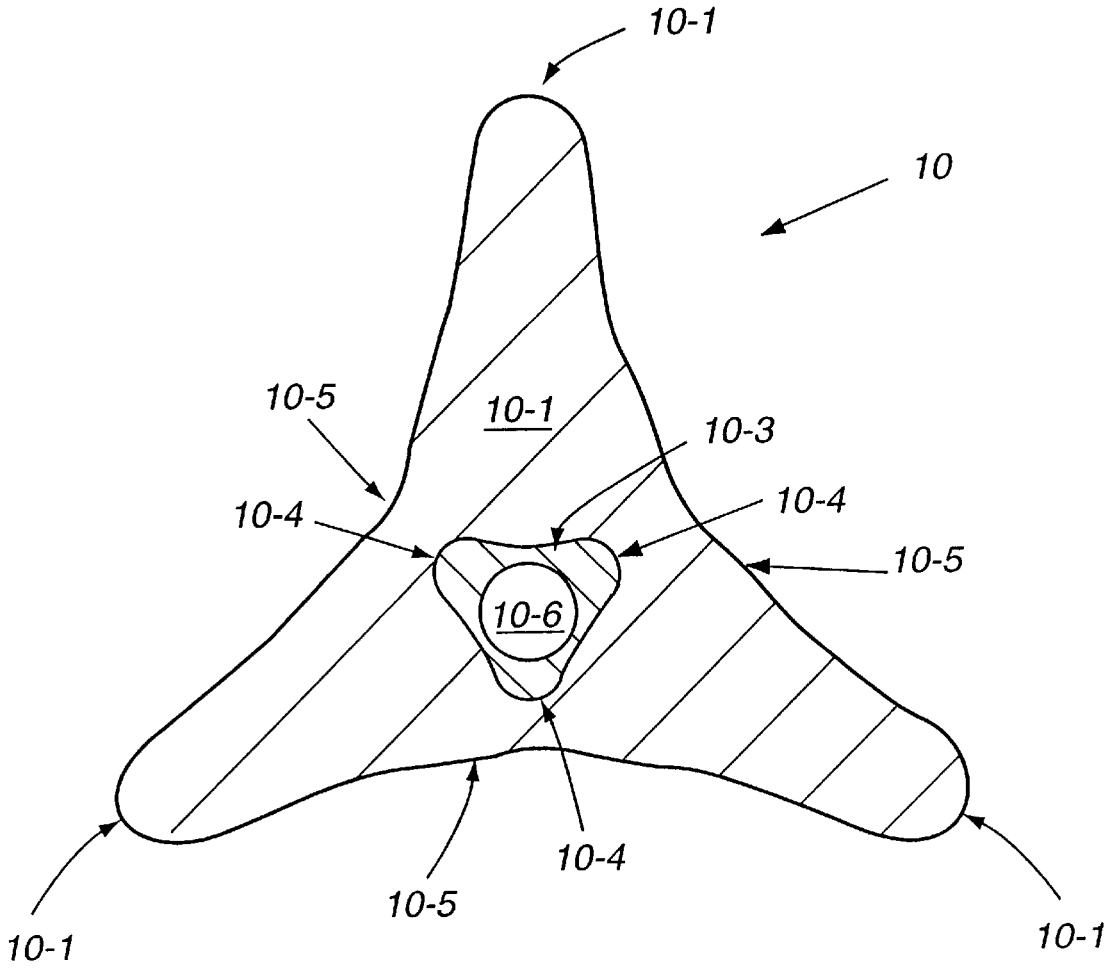
FIG. 7 is an enlarged schematic cross-sectional illustration of one possible trilobal fiber in accordance with the present invention.
Figure 8:
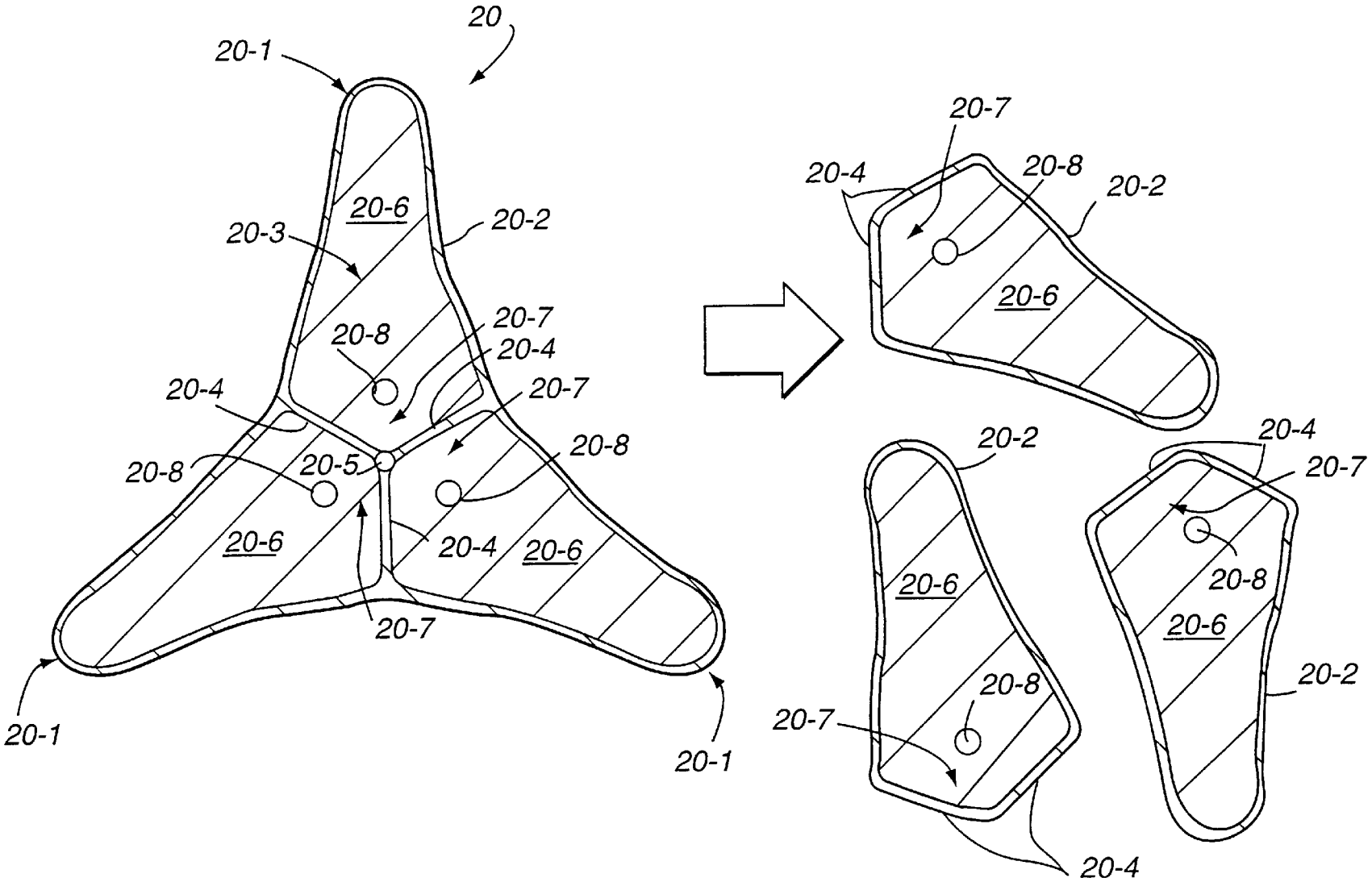
FIG. 8 is an enlarged schematic cross-sectional illustration of another possible trilobal fiber in accordance with the present invention.

Accompanying FIGS. 7 and 8 schematically depict possible cross-sectional configurations for trilobal fibers in accordance with the present invention. In this regard, the trilobal fiber 10 depicted in accompanying FIG. 7 includes sheath component 10-1 having three primary lobes 10-2 and a core component 10-3. The core component 10-3 is itself generally triangularly shaped with the core lobes 10-4 thereof being symmetrically oriented, but out-of-phase, with the fiber lobes 10-2. That is, the core lobes 10-4 are disposed adjacent the sheath valleys 10-5 between adjacent ones of the lobes 10-2 so that the core lobes 10-4 substantially bisect the angle between such adjacent fiber lobes 10-2. Moreover, It will be observed that the core component 10-3 defines a centrally located hole 10-6 extending the entire length of the fiber 10.

The fiber 20 shown in accompanying FIG. 8 is also a trilobal fiber in that it includes three primary lobes 20-1. The fiber 20 includes a relatively thin sheath component 20-2 which most preferably entirely surrounds the core component 20-3. Importantly, the fiber 20 includes at least one, and preferably multiple, radially extending rivulets 20-4 of the sheath polymer. Specifically, in the embodiment depicted in accompanying FIG. 8, these rivulets 20-4 radially extend from a central longitudinally extending hole 20-5 so as to substantially bisect the angle between adjacent fiber lobes 20-1 and form individual asymmetrical wedge-shaped core component sections 20-6. As seen, the relatively thicker base 20-7 of the sections most preferably defines a longitudinally extending hole 20-8. It has been found that, during further processing operations (e.g., whereby longitudinal tensions are exerted on the fibers 20), the individual wedge-shaped sections 20-6 can be caused to separate one from one another so as to form individual fibers thereof which would otherwise be quite difficult to melt-spin.

The central holes 10-6 and 20-5 of fibers 10 and 11, respectively and the wedge-base holes 20-8 of fiber 11 are optional. That is, the holes 10-6, 20-5 and/or 20-8 may be present or absent from the fibers 10 and 11 as will become apparent from the Examples below.

EXAMPLES

Further understanding of this invention will be obtained from the following non-limiting Examples which illustrate specific embodiments thereof.

Examples 1 through 6

Yarns formed from 112 bicomponent sheath-core cross section trilobal filaments, 16.63 denier per filament (dpf), were produced on pilot plant bicomponent spinning equipment in a two step process. Two single screw extruders were used to melt and transfer two thermoplastic nylon 6 polymers separately to a bicomponent spin pack. The two polymer melt flows were then combined above each spinneret capillary counterbore using thin plate flow distributors as described in the above-cited U.S. Pat. Nos. 5,162,074 and 5,344,297.

The bicomponent polymer streams were then formed into trilobal cross-section filaments using a 112-hole spinneret. Each hole of the spinneret had a nominal 1.90 mm diameter defining three arms 0.85 mm in length as measured from the geometric center of the hole radially spaced-apart from one another by 120°. The central juncture from which the arms radiated was beveled 0.124 mm as measured between a diametrical plane of the spinneret and a parallel plane containing the beveled surface.

The sheath polymer was supplied by a 38 mm diameter screw extruder (Automatik). The core polymer was supplied by a 2" diameter screw extruder (Davis Standard). The nylon 6 polymers used were 2.4, 3.3 and 4.0 RV (polymer relative viscosities as measured in sulfuric acid). Carbon black pigmented chip was blended with the 2.4 RV polymer chip (1 wt. % concentration) as an indicator to allow for easier identification of the polymer domain locations in the resulting fiber cross-section. Table 1 below shows the machine settings employed and Table 2 shows the respective spinning conditions for each of Examples 1–6.

TABLE 1

| EXTRUDER | Sheath Extruder | nCore Extruder |
|---|---|---|
| Zone 1 temp, C. | 245 | 245 |
| Zone 2 temp., C. | 255 | 260 |
| Zone 3 temp., C. | 260 | 265 |
| Zone 4 temp., C. | 265 | 270 |
| Zone 5 temp., C. | 270 | No Zone 5 |
| Head temp., C. | 270 | 270 |
| Mixer/Filter temp., C. | 270 | 270 |
| Transfer Line temp., C. | 270 | 270 |
| Extruder Pressure, psig | 1800 | 1800 |
| Melt pump size, cc/rev | 10 | 10 |
| Spin Beam Temp., C. | 270 | 270 |

TABLE 2

| | Sheath Extruder | | | Core Extruder | | |
|---|---|---|---|---|---|---|
| Example # | Polymer RV | Wt. %[1] | Pump Yield, gpm | Polymer RV | Wt. %[1] | Pump Yield, gpm |
| 1 | n.a.[2] | 0 | 0 | 3.3 | 100 | 360.09 |
| 2 | n.a. | 0 | 0 | 2.4 | 100 | 360.09 |
| 3 | 2.4 | 30 | 108.03 | 3.3 | 70 | 252.07 |

TABLE 2-continued

| | Sheath Extruder | | | Core Extruder | | |
|---|---|---|---|---|---|---|
| Example # | Polymer RV | Wt. %[1] | Pump Yield, gpm | Polymer RV | Wt. %[1] | Pump Yield, gpm |
| 4 | 3.3 | 30 | 108.03 | 2.4 | 70 | 252.07 |
| 5 | 2.4 | 30 | 108.03 | 4.0 | 70 | 252.07 |
| 6 | 2.4 | 50 | 180.05 | 4.0 | 50 | 180.05 |

Notes:
[1]-Weight Percent of each component in the fiber.
[2]-n.a. Not applicable The extruded bicomponent fibers were spun in a conventional quench chimney using crossflow unconditioned air. A conventional finish was applied at a level of 1.5%. The undrawn yarn was taken up on a winder bobbin at a speed of 600 mpm.

The resulting undrawn yarn packages were transferred to a draw-texturing machine, drawn at a ratio of approximately 2.5:1 and then tested for yarn physical properties such as Modification Ratio (MR), Bulk, CPI (Crimps per inch) in dry as well as latent heat, yarn shrinkage in dry as well as latent heat, Elongation to break (ETB), Tenacity (TEN), toughness (TGH) and Modulus (MOD). Such properties appear in the "Drawn/Textured" data of Table 3A below. Other packages of the same example condition were textured and these properties are shown with the "Drawn Only" data in Table 3B below. Accompanying FIGS. 1–6 are photomicrographs of the yarn samples obtained in each of Examples 1–6, respectively.

TABLE 3A

Drawn/Textured

| Ex. No. | Avg. MR | % Dry Bulk | % Wet Bulk | CPI-Dry | CPI-Wet | CPI-TEX | Denler | % Shrink (Wet) | % Shrink (Dry) | ETB | TEN | TGH | MOD (3%) | MOD (5%) | MOD (10%) |
|---|---|---|---|---|---|---|---|---|---|---|---|---|---|---|---|
| 1 | 3.12 | 6.6 | 11.4 | — | — | 9.8 | 2434 | 3.4 | 0.9 | 43.2 | 2.08 | 0.51 | 6.68 | 6.21 | 5.7 |
| 2 | 1.27 | 1.8 | 3.8 | 0.5 | 1.6 | — | 2149 | 7.7 | 5.6 | 62.5 | 2.14 | 0.89 | 14.12 | 12.59 | 9.9 |
| 3 | 3.64 | 7.0 | 10.6 | — | — | 12.9 | 2434 | 3.9 | 1.5 | 40.4 | 2.06 | 0.49 | 7.36 | 6.79 | 6.24 |
| 4 | 2.52 | 7.9 | 15.3 | — | — | 10.6 | 2373 | 3.3 | 1.1 | 41.4 | 1.96 | 0.49 | 7.44 | 7.00 | 6.47 |
| 5 | 3.92 | 7.9 | 14.8 | — | — | 9.8 | 2451 | 3.9 | 1.6 | 31.2 | 2.06 | 0.32 | 5.89 | 5.7 | 5.57 |
| 6 | — | — | — | — | — | — | — | — | — | — | — | — | — | — | — |

TABLE 3B

Drawn Only

| Ex. No. | Avg. MR | % Dry Bulk | % Wet Bulk | CPI-Dry | CPI-Wet | CPI-TEX | Denler | % Shrink (Wet) | % Shrink (Dry) | ETB | TEN | TGH | MOD (3%) | MOD (5%) | MOD (10%) |
|---|---|---|---|---|---|---|---|---|---|---|---|---|---|---|---|
| 1 | 3.12 | 2.2 | 6.5 | 2.1 | 1.7 | — | 2180 | 10.0 | 6.9 | 28 | 2.41 | 0.43 | 13.39 | 12.07 | 12.73 |
| 2 | 1.27 | 1.8 | 3.8 | 0.5 | 1.6 | — | 2149 | 7.7 | 5.6 | 62.5 | 2.14 | 0.89 | 14.12 | 12.59 | 9.9 |
| 3 | 3.64 | 2.7 | 7.8 | 3.9 | 5.1 | — | 2246 | 9.9 | 7.4 | 30.4 | 2.38 | 0.48 | 13.25 | 12.03 | 13.12 |
| 4 | 2.52 | 7.3 | 7.3 | 2.8 | 4.2 | — | 2182 | 7.1 | 6.0 | 32.7 | 2.22 | 0.50 | 13.41 | 12.36 | 12.59 |
| 5 | 3.92 | 10.5 | 17.6 | 6.4 | 5.3 | — | 2217 | 10.8 | 8.0 | 15.6 | 2.26 | 0.17 | 12.97 | 12.16 | 14.67 |
| 6 | 3.69 | 7.7 | 14.2 | 5.4 | 6.0 | — | 2435 | 9.7 | 6.8 | 25.6 | 2.09 | 0.34 | 12.85 | 11.57 | 12.33 |

Example 7

Nylon 6 (BS700-F from BASF Corporation of Mount Olive N.J.) and nylon 6,12 (Vestamid D18 from Hüls America of Piscataway, N.J.) were combined to form sheath/core hollow trilobal filaments. The temperature of each polymer entering the spinneret was 270° C. The spin pack used thin plates similar to those described in U.S. Pat. No. 5,344,297, U.S. Pat. No. 5,162,074, and U.S. Pat. No. 5,551,588 all by Hills. Specifically, above the backhole leading to the spinning capillary were thin plates designed to deliver the nylon 6,12 to the center of the backhole above the capillary. The nylon 6 was delivered to the periphery of the backhole at three equidistant positions so as to form the sheath. The nylon 6,12 was 15% by weight of the fiber. The capillary used was generally in accordance with U.S. Pat. No. 5,208,107 (incorporated herein by reference) but had a diameter of 2.5 mm. The resulting fiber had a modification ratio of 2.2.

Figure 9:
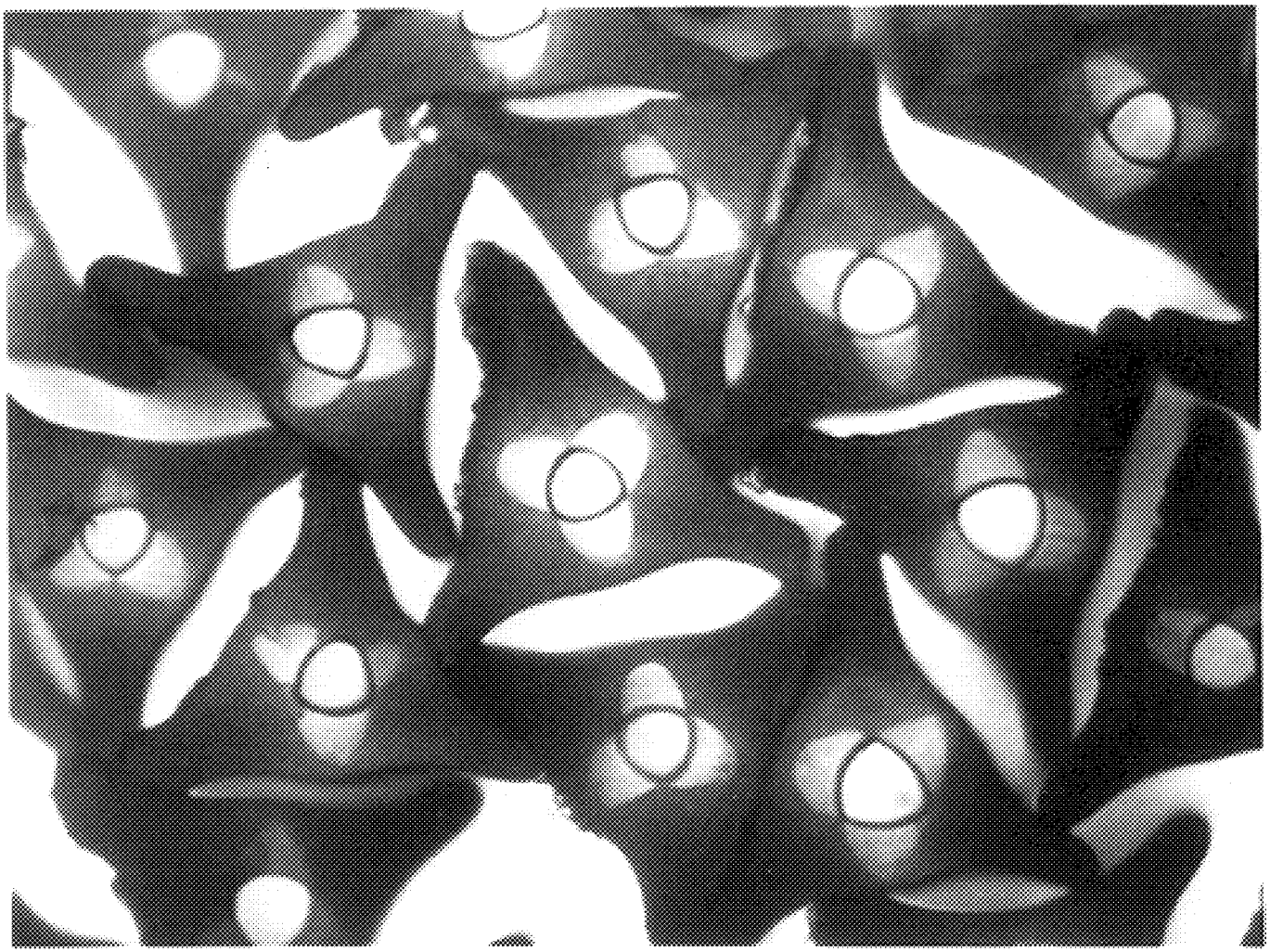
FIG. 9 is a photomicrograph taken at a magnification of about 303× of fibers produced in accordance with Example 7 below.

By the addition of a black pigment to the nylon 6 phase, it was possible to image the two polymeric phases. As can be seen in FIG. 9, the nylon 6,12 core had had a generally triangular (i.e., three lobed) appearance with each lobe positioned intermediate the lobes of the overall fiber (i.e., in alignment with the valleys so as to substantially bisect the angle between adjacent lobes). The core also included a large central void extending the length of the fiber. The fiber was extruded, and then drawn between heated sets of rolls with a draw ratio of approximately 3.2. The yarn was then textured using hot air and subsequently wound onto a cardboard tube at approximately 2250 meters per minute. Other than the bicomponent spin pack and extruders the equipment used was typical of one step, bulked, continuous, filament carpet fiber spinning equipment.

Example 8

Figure 10:
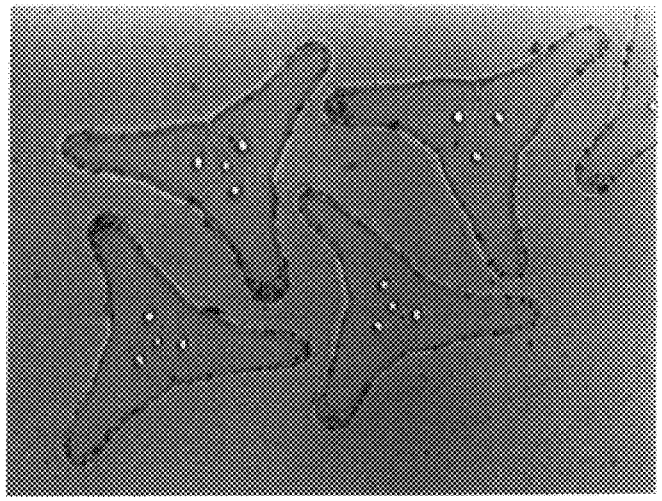
FIG. 10 is a photomicrograph taken at a magnification of about 200× of fibers produced in accordance with Example 8 below.

The same materials, temperatures, and equipment were used as in Example 7, except that the nylon 6,12 entered the backhole at the periphery and the nylon 6 entered the center of the backhole. The weight percent of nylon 6,12 in the fibers was 25%. These fibers had a modification ratio of 2.9. As can be seen in FIG. 8, four voids comprised of a small center void surrounded by three larger voids each located along the axis of one leg of the trilobal fiber were formed. This cross section can be seen in FIG. 10.

Example 9

Figure 11:
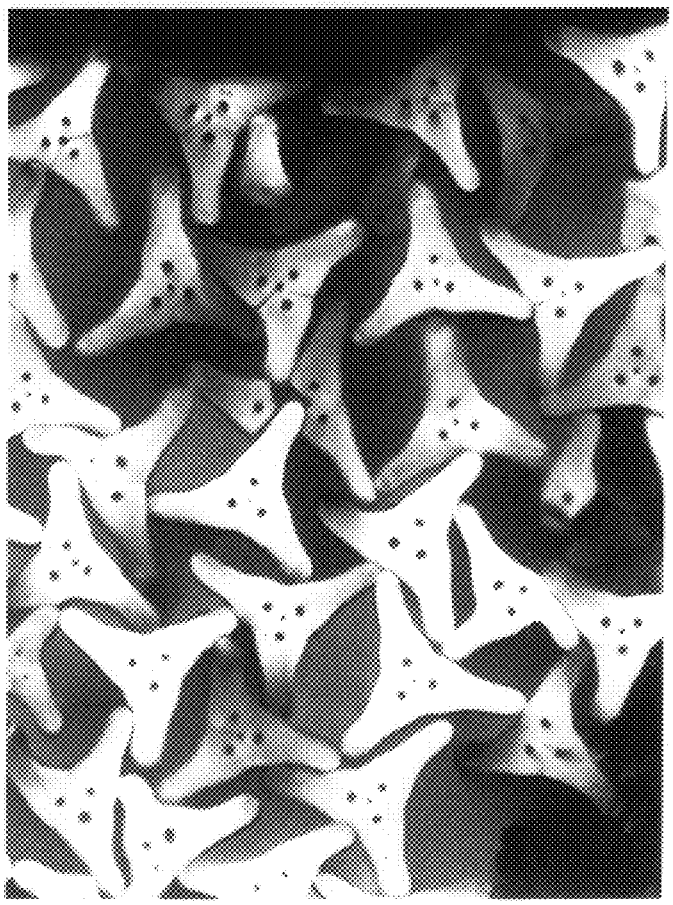
FIG. 11 is a photomicrograph taken at a magnification of about 303× of fibers produced in accordance with Example 9 below.

Example 8 was repeated, except the weight percent of nylon 6,12 used was 15%. The modification ratio of these fibers was 3.0. In some cases the center void was absent. A black pigment was added to the nylon 6,12 sheath to determine the location of the two nylon phases. Representative cross sections of the fibers are shown in FIG. 11. The nylon 6,12 was substantially on the outside of the cross section, but a small amount could be seen radially extending from the valley between adjacent lobes to the center of filament cross section.

Example 10

Example 8 was repeated, except that the amount of nylon 6,12 in the filaments was 10%. These fibers had a modification ratio of 2.9 and, in relation to the fibers of Example 9, these fibers seemed to more often exhibit the absence of the fourth center void Example 11

Example 2 was repeated, except that the amount of nylon 6,12 in the filaments was 5%. These fibers had a modification ratio of 2.7 and seldom formed the fourth void which was seen with regularity in Example 8. These fibers in some cases developed a single large, central void, and in other cases, fibers having one large void and one smaller void were formed.

Example 12

When the filaments from Example 9 were handled by knitting and deknitting, in many cases the filaments would break apart to form individual hollow bicomponent fibers which had generally an asymmetrical wedge shape with a void located within the thicker end of the wedge. Microscopy indicated that in many cases the fibers were completely sheathed with the nylon 6,12. In others the shortest side of the wedge had little, if any, sheathing of nylon 6,12 polymer.

Example 13 (Comparative)

The nylon 6,12 in Example 9 was replaced with the same nylon 6 that was used to form the core of the fibers in Example 9 thereby forming a 100% nylon 6 fiber. Almost all fibers had a single void and a modification ratio of 2.4.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a synthetic bicomponent fiber comprising the steps of:

(i) co-melt-spinning first and second fiber-forming polymers exhibiting a differential relative viscosity therebetween through a common fiber-forming orifice of fixed geometry so as to form a synthetic bicomponent fiber having a first modification ratio and desired cross-sectional bicomponent distribution and relative proportions of the first and second polymers; and then (ii) changing at least one of (1) the differential relative viscosity of the first and second polymers, (2) the relative proportions of the first and/or second polymers, and (3) the cross-sectional bicomponent distribution of the first and second polymers, so as to form another bicomponent fiber having a second modification ratio which is different from said first modification ratio without changing said fixed geometry orifice through which said first and second polymers are co-melt-spun.

2. The process as in claim 1, wherein each of the first and second polymers is a nylon polymer.

3. The process as in claim 2, wherein each of said first and second polymers is a nylon-6 polymer.

4. The process as in claims 1–3 wherein the differential relative viscosity between said first and second polymers is at least about 0.3.

5. The process as in claim 4, wherein the differential relative viscosity between said first and second polymers is at least about 0.5.

6. The process as in claim 4, wherein the differential relative viscosity between said first and second polymers is between about 0.7 to about 2.0.

7. The process as in claim 4, wherein the differential relative viscosity between said first and second polymers is between about 0.9 to about 1.6.

8. The process as in claim 1, wherein step (i) is practiced by co-melt-spinning said first and second polymers through a tri-lobal spinneret.

9. The process as in claim 1, wherein step (ii) is practiced by changing the differential relative viscosities between said first and second polymers.

10. The process as in claim 1, which includes forming at least one longitudinally extending hole in the bicomponent fiber.

11. The process as in claim 10, which includes forming multiple longitudinally extending holes in the bicomponent fiber.

12. A process for forming a multilobal bicomponent fiber comprising co-melt-spinning first and second fiber-forming polymers through a spinneret so as to form a multilobal fiber having a first cross-sectional geometry comprised of core and sheath fiber components respectively formed of said first and second fiber-forming polymers and wherein the core component is generally triangularly shaped wherein said step of co-melt-spinning forms at least one rivulet of said second fiber-forming polymer which radially extends toward a central region of said bicomponent fiber.

13. The process of claim 12, comprising forming multiple rivulets during said co-melt-spinning step such that said rivulets radially extend in directions which substantially bisect an angle between adjacent fiber lobes and thereby establish discrete wedge-shaped fiber regions.

14. The process of claim 13, comprising separating the discrete wedge-shaped fiber regions one from another.

15. The process of claim 14, wherein said separating step includes subjecting the fibers to longitudinal tension.

16. The process of claim 12, which includes changing at least one of (1) the differential relative viscosity of the first and second polymers, (2) the relative proportions of the first and/or second polymers, and (3) the cross-sectional bicomponent distribution of the first and second polymers, so as to form another bicomponent fiber having a second cross-sectional geometry which is different from said first cross-sectonal geometry.

17. A process for forming a multilobal bicomponent fiber comprising co-melt-spinning first and second fiber-forming polymers through a spinneret so as to form a multilobal fiber having a first cross-sectional geometry comprised of core and sheath fiber components respectively formed of said first and second fiber-forming polymers and wherein the core component is generally triangularly shaped wherein said generally triangularly shaped core component has core lobes which are oriented so as to generally bisect an angle between adjacent bicomponent fiber lobes.

18. The process of claim 17, wherein said core component defines a longitudinally extending central hole.

* * * * *